United States Patent [19]

Fiala

[11] 4,455,983

[45] Jun. 26, 1984

[54] METHOD AND ARRANGEMENT FOR OPERATION OF AN INTERNAL COMBUSTION ENGINE OF A VEHICLE

[75] Inventor: Ernst Fiala, Wolfsburg, Fed. Rep. of Germany

[73] Assignee: Volkswagenwerk Aktiengesellschaft, Wolfsburg, Fed. Rep. of Germany

[21] Appl. No.: 439,727

[22] Filed: Nov. 8, 1982

Related U.S. Application Data

[62] Division of Ser. No. 163,491, Jun. 27, 1980, Pat. No. 4,377,995.

[30] Foreign Application Priority Data

Jun. 28, 1979 [DE] Fed. Rep. of Germany ..... 2926106

[51] Int. Cl.[3] ..... F02M 51/00

[52] U.S. Cl. ..... 123/478; 123/361; 123/486; 123/340; 123/344

[58] Field of Search ..... 123/339, 340, 344, 350, 123/363, 438, 480, 486, 478; 74/860

[56] References Cited

U.S. PATENT DOCUMENTS

| | | | |
|---|---|---|---|
| 3,485,316 | 12/1969 | Slavin et al. | 123/360 |
| 3,643,635 | 2/1972 | Milam | 123/357 |
| 3,835,819 | 9/1974 | Anderson | 123/480 |
| 3,906,205 | 9/1975 | Yoshida et al. | 123/486 |
| 3,916,854 | 11/1975 | Barton et al. | 123/363 |
| 4,133,406 | 1/1979 | Allerdist | 123/352 |
| 4,168,679 | 9/1979 | Ikeura et al. | 123/486 |
| 4,200,007 | 4/1980 | Espenschied et al. | 123/350 |
| 4,300,501 | 11/1981 | Suzuki | 123/339 |
| 4,367,709 | 1/1983 | Codrington | 123/339 |
| 4,388,907 | 6/1983 | Sugo et al. | 123/478 |
| 4,398,515 | 8/1983 | Canup et al. | 123/478 |

*Primary Examiner*—Parshotam S. Lall

*Attorney, Agent, or Firm*—Brumbaugh, Graves, Donohue & Raymond

[57] ABSTRACT

The operation of a motor vehicle is controlled by reading of a programmed memory to accelerate the vehicle along a predetermined optimum efficiency curve. The acceleration is independent of the position of the accelerator pedal, provided the pedal is neither in the idling position nor in the full throttle position. For these positions, the acceleration of the vehicle is not under the control of the programmed device.

22 Claims, 7 Drawing Figures

METHOD AND ARRANGEMENT FOR OPERATION OF AN INTERNAL COMBUSTION ENGINE OF A VEHICLE

This is a division of application Ser. No. 163,491, filed June 27, 1980, now U.S. Pat. No. 4,377,995.

BACKGROUND OF THE INVENTION

This invention relates to a method and apparatus for controlling the operation of an internal combustion engine of a motor vehicle in order to achieve optimum fuel efficiency.

It is customary to control the driving power of a motor vehicle internal combustion engine by modification of the supply of fuel to the engine, for example, by influencing the control of a fuel metering device, such as the throttle flap in a carburetor or the injection quantity per stroke in a fuel injected diesel engine. Within the limits of engine operating parameters, it is usually left to the driver to determine what gear should be used and what accelerator pedal position will be set for any particular operating situation. Since only a defined power of the engine is available at each engine rotational speed for optimum engine fuel efficiency, this manner of operation oftern leads to unnecessarily high fuel consumption.

In U.S. Pat. No. 3,916,854, there is described an apparatus wherein the position of a throttle valve is not directly controlled by movement of the accelerator pedal. The throttle valve is only allowed to reach a position which is predetermined by means of a cam connected to a governor, so that during the running-up of the engine, the engine accelerates along a curve with a view to minimal fuel consumption for attainment of maximum power at all engine rotational speeds. Following attainment of the selected throttle valve position, in accordance with the accelerator pedal setting, the operating point travels over a curve of more unfavorable consumption, corresponding to a constant throttle valve setting, according to the position of the accelerator pedal, until the traction resistance curve is reached.

It is an object of the present invention to provide a method and apparatus for providing more efficient operation of a motor vehicle by the use exclusively of a preselected curve in the power-speed diagram which connects the operating points of maximum power at predetermined fuel consumption.

SUMMARY OF THE INVENTION

In accordance with the present invention there is provided a method for operating an internal combustion engine for a motor vehicle having a multi-speed transmission, an accelerator pedal, and a fuel metering device. The method includes the step of monitoring engine rotational speed and controlling the setting of the fuel metering device to provide the highest ratio of output power to fuel consumption at each operating speed of the engine. The setting control is triggered by operation of the accelerator pedal, but is independent of pedal position. Accordingly the desired output power of the engine is obtained by either shifting the speed of the transmission between adjacent gears, or activating and releasing the accelerator pedal.

In a preferred embodiment, the accelerator pedal of the engine may be fully depressed, bypassing the control mechanism and thereby providing full output power from the engine. Upon release of the accelerator pedal, the fuel metering device assumes the idling condition. Further, upon disengagement of the clutch, the fuel metering device follows a power-speed relationship which is optimum for clutch engagement.

In accordance with the present invention there is provided an apparatus for controlling the setting of a fuel metering device for an internal combustion engine for a motor vehicle having an accelerator pedal, to provide the setting which yields the highest ratio of output power to fuel consumption for each operating speed of the engine. The apparatus includes an engine speed sensor, a memory for storing the fuel metering device setting to be used at each operating speed, the memory including means responsive to the speed sensor for providing an output setting and operating means responsive to the memory output for setting the fuel metering device. There is finally provided a first switch operated by the accelerator pedal for connecting the memory to the operating means.

In a preferred embodiment the first switch alternately connects the operating means to the memory or to the accelerator pedal. There may be provided second and third switches, responsive to the accelerator pedal reaching the idle or full throttle positions respectively, and the first switch responds to operation of those switches to directly connect the accelerator pedal to the operating means. There may further be provided a signaling device responsive to the operation of the third switch for signaling that the engine is operating at full throttle condition, and not in the mode best for fuel consumption.

In other embodiments there may be provided a second set of fuel metering device settings in the memory, the second set being appropriate for engine operation during start-up. In this case, the means for providing an output setting is responsive to movement of the clutch out of the engaged position, to select output settings from the second set of output settings.

The invention is advantageously used in connection with a transmission having an overrun mechanism operative in at least one speed. The power output settings as a function of engine speed are preferably close to the traction resistance curve for the vehicle in the highest speed of transmission operation. Means can be provided responsive to the operation of the vehicle's brake pedal for causing the operating means to set the fuel metering device to the idling position. The output of the memory unit can also be provided to an indicating instrument for providing the vehicle operator with an indication of fuel consumption.

There can also be provided, in connection with the invention, an apparatus for responding to the memory output for providing a signal indicating to the driver that it is appropriate to shift to the next highest transmission gear.

The values for the setting of the fuel metering device, stored in the memory and supplied to the operative device, can be varied in accordance with engine operating temperature to achieve optimum engine operation during cold or warm operating conditions.

In another embodiment, there are provided stored speed regulating curves, having points of intersection with the traction resistance curve, which are preselected operating points of the engine. In this case the vehicle instrument panel can be provided with a switch for manual setting of the speed regulation curve. A storage may be provided for storing the desired engine speed value, which is selected in accordance with operation of an instrument panel switch. A manually actuable control can be provided for manual input of the selected speed value into the storage device. The input of the value in the storage device can be provided by activation of a full throttle contact on the accelerator pedal. The idling contact on the accelerator pedal can be used as a control switch to return the vehicle to manual control. In one embodiment the selected speed regulation curves are fixed speeds for the lower transmission speeds values, but adjustable upon activation of the highest transmission speed. In this case, in the lower gears, the operating point of the engine is preferably set at half the maximum engine speed.

For a better understanding of the present invention, together with other and further objects, reference is made to the following description, taken in conjunction with the accompanying drawings, and the scope will be pointed out in the appended claims.

BRIEF DESCRIPTION OF THE DRAWINGS

FIG. 3 is a graph of engine output power as a function of rotational speed illustrating the optimum acceleration curve b and the optimum clutch engagement curve a.

DESCRIPTION OF THE INVENTION

Figure 1:
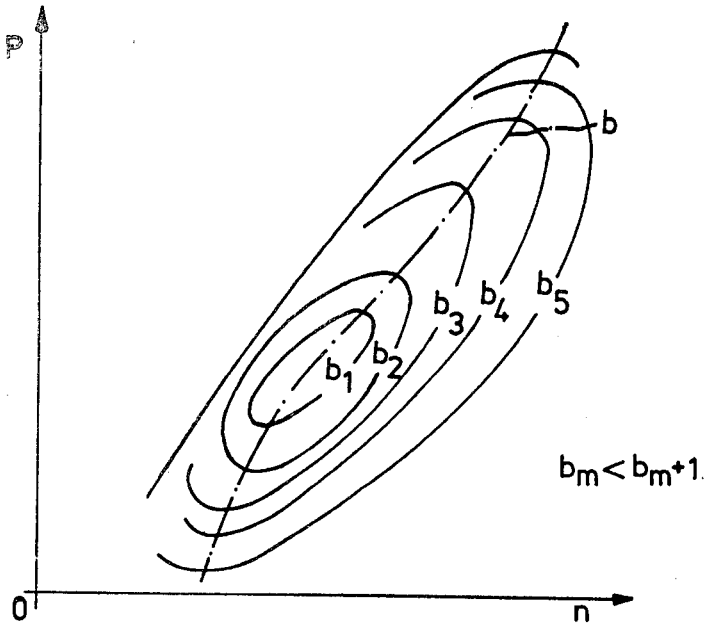
FIG. 1 is a graph of engine output power as a function of engine rotational speed showing contours of equal fuel efficiency.

In FIG. 1 there is shown a graph illustrating the engine output power p as a function of engine rotational speed n for a carburetor or diesel engine for use in a motor vehicle. On the graph there are illustrated contours of equal specific fuel consumption $b_1$, $b_2$, $b_3$, $b_4$ and $b_5$. These contours represent equal values of fuel consumption in grams per kilowatt hour of output, so that they relate the actual work done by the engine to the fuel consumed. Line b, in dots and dashes, is a line of engine operation for optimum fuel consumption. This line corresponds to the rotational speed and output power values which can be obtained with the lowest possible fuel consumption. For any selected value of engine output power, curve b designates the engine rotational speed for optimum fuel consumption. Curve b therefore indicates the rotational speed at which there is the highest ratio of output power to fuel consumption. If a vehicle is operating on this curve as much as possible, the lowest possible fuel consumption at the desired speed is obtained for the vehicle.

Figure 2:
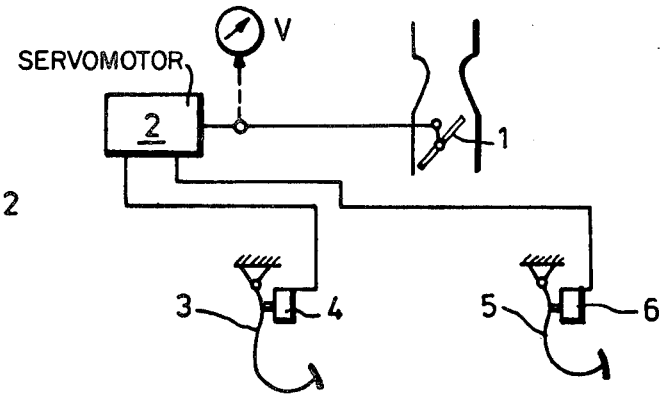
FIG. 2 is a diagram illustrating an embodiment of the present invention for use in a motor vehicle.
Figure 3:
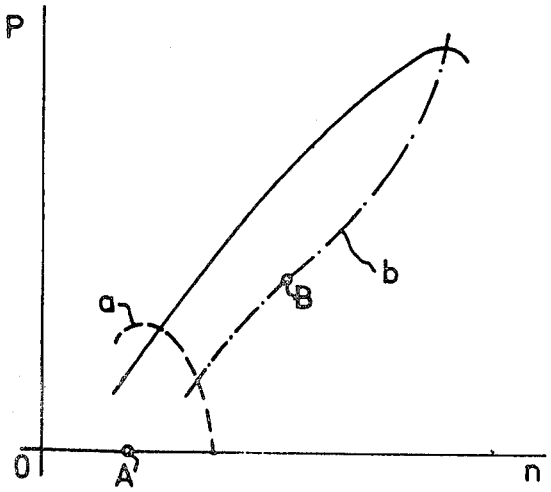

Referring to FIG. 2, there is shown an overall diagram for a control apparatus for achieving the operation of a vehicle along the line of optimum consumption b shown in FIG. 1. In the drawing there is shown a throttle 1 for use in controlling the amount of fuel supplied to a gasoline powered internal combustion engine. The throttle valve 1 comprises a fuel metering device which, in the case of a diesel engine, would correspond to the control rod for a fuel injection pump. Throttle 1 is operated by a servo-motor having a control means, which is designated as 2. This type of servo-motor is known in connection with speed governors. The vehicle includes a clutch pedal 3, which is provided with a switch 4, which closes when the clutch pedal moves even a small amount out of its rest position. The accelerator pedal 5 is likewise provided with a switch 6, which closes when the accelerator pedal moves out of the idling position. When the pedals 3 and 5 are in their rest positions, the engine is idling, which is at a point A illustrated in FIG. 3. If the accelerator pedal is depressed, closing switch 6, the servo-motor will cause the throttle to assume engine operation according to the optimum consumption curve b shown in FIG. 3, as long as switch 4 is not actuated. If switch 4 is actuated, the control unit 2 will operate according to curve a, which is optimum for clutch engagement upon the start of driving. Accordingly, optimum engine operation is obtained without the operator having to acquire any new skills in the manner of vehicle operation.

Following actuation of clutch pedal 3 and shifting of the transmission into the first gear, with the engine idling at operating point A, the driver depresses the accelerator pedal 5 closing switch 6. Since the clutch pedal 3 is not in its fully released position opening switch 4, control unit 2 will provide vehicle operation along curve a providing an easy start of vehicle motion with the customary clutch engagement. Upon full engagement of the clutch, switch 4 is opened, whereupon the control unit 2 controls the throttle valve 1 in conformity with the optimum consumption curve b, on which are placed the operating points B having minimum specific comsumption. The vehicle accelerates as the power p increases. If the power desired by the operator is exceeded, the operator will shift into second, or more generally, the next higher gear.

In the process of shifting gears, the operator will release the throttle, closing switch 6. Servo-motor 2 will then set the controls for idling at condition A. The operator will then depress the clutch pedal, change gears, release the clutch pedal, and accelerate, so that the servomotor with regulator will again control the operation according to curve a, during clutch engagement and then according to curve b during acceleration in gear, until the power provided by curve b is either too great for the driver's liking, in which case he will engage the next higher gear, or too small, in which case he will shift down, or possibly be precisely the power needed in the gear engaged. If it becomes necessary to reduce speed, the driver will release the accelerator and the throttle valve 1 will return to the idling position while the engine brakes in a customary manner, depending on which gear is engaged. Since each point on curve b is associated with a specific consumption $b_m$, a consumption indicator V may be connected to the output of the control unit 2.

Figure 4:
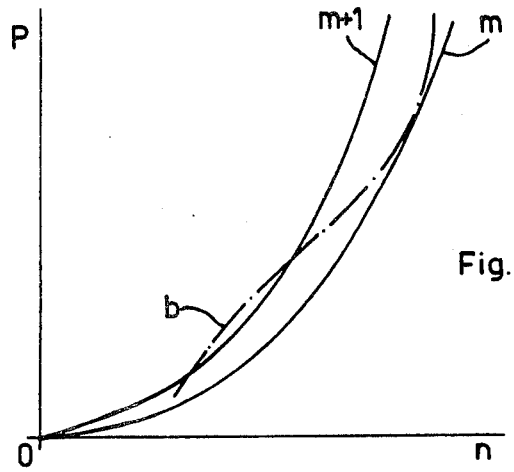
FIG. 4 is a graph of engine output power versus engine rotational speed illustrating traction resistance curves and illustrating the optimum acceleration curve b.

In accordance with the invention driving at optimum consumption is attained without any special attention by the vehicle operator. A prerequisite for optimum operation is that the traction resistance curves, lines m, m+1 in FIG. 4, associated with the various transmission speeds, intersect with the curves b at the point which correspond to the desired speed. Inasmuch as this condition will not be attained, in general, the driver will have to shift repeatedly between adjacent gears, or alternatively will have to release and depress the accelerator pedal. The vehicle will move with slight acceleration or deceleration, but in any case at optimum fuel consumption. Instead of changing gears, the driver can release the accelerator. In the event that an overrunning device is provided, the engine will drop to the idling point A and the vehicle will coast until it is again accelerated by the driver by renewed depressing of the accelerator. This manner of operation will result in slightly increased consumption relative to the manner of changing gears.

Figure 5:
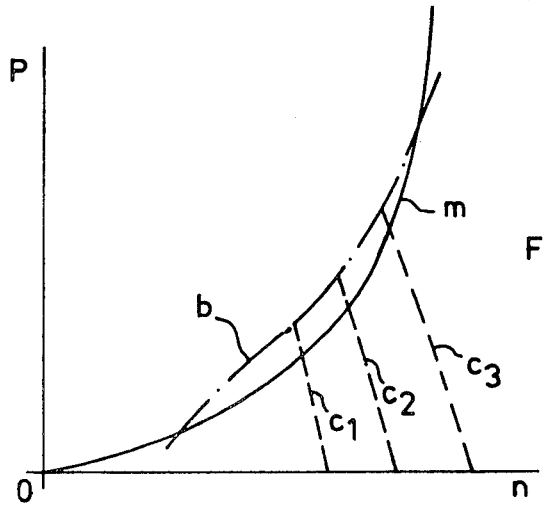
FIG. 5 is a graph of engine output power as a function of engine rotational speed illustrating the optimum acceleration curve b, a traction resistance curve m, and speed regulation curves $c_1$, $c_2$ and $c_3$.

Another manner of operating the vehicle according to the present invention consists of providing an adjustable speed limitation in the optimum consumption curve diagram. FIG. 5 shows the branches $c_1$ through $c_3$ which are downward regulation curves intersecting curve b and also intersecting the traction resistance curve m associated with the highest vehicle gear. Operation at these points of intersection requires a larger consumption relative to operation on the optimum consumption curve b, but the difference is very small, since the intersecting points of curve b are approximate to the optimum curve. This arrangement provides operation as a speed governing system.

Speed limitation with the help of branch curves c can be useful in the lower gears so that operation may be maintained in the vicinity of the absolute fuel consumption minimum. Moreover, outward engine noise levels can be adhered to by avoiding engine operation at excessive rotational speed.

A problem may arise in that the maximum output power of the engine should be available in an emergency or for use in a steep upward climb. In this case considerations other than those pertaining to optimum fuel consumption are predominant. Upon demand for full power, the servo-motor with regulator 2, relinquishes operation according to curve b and must set the throttle valve 1 at full throttle. A switch to be provided towards this end can at the same time also actuate a warning flasher device so that the non-optimum mode of engine operation is signaled outside the vehicle.

Figure 6:
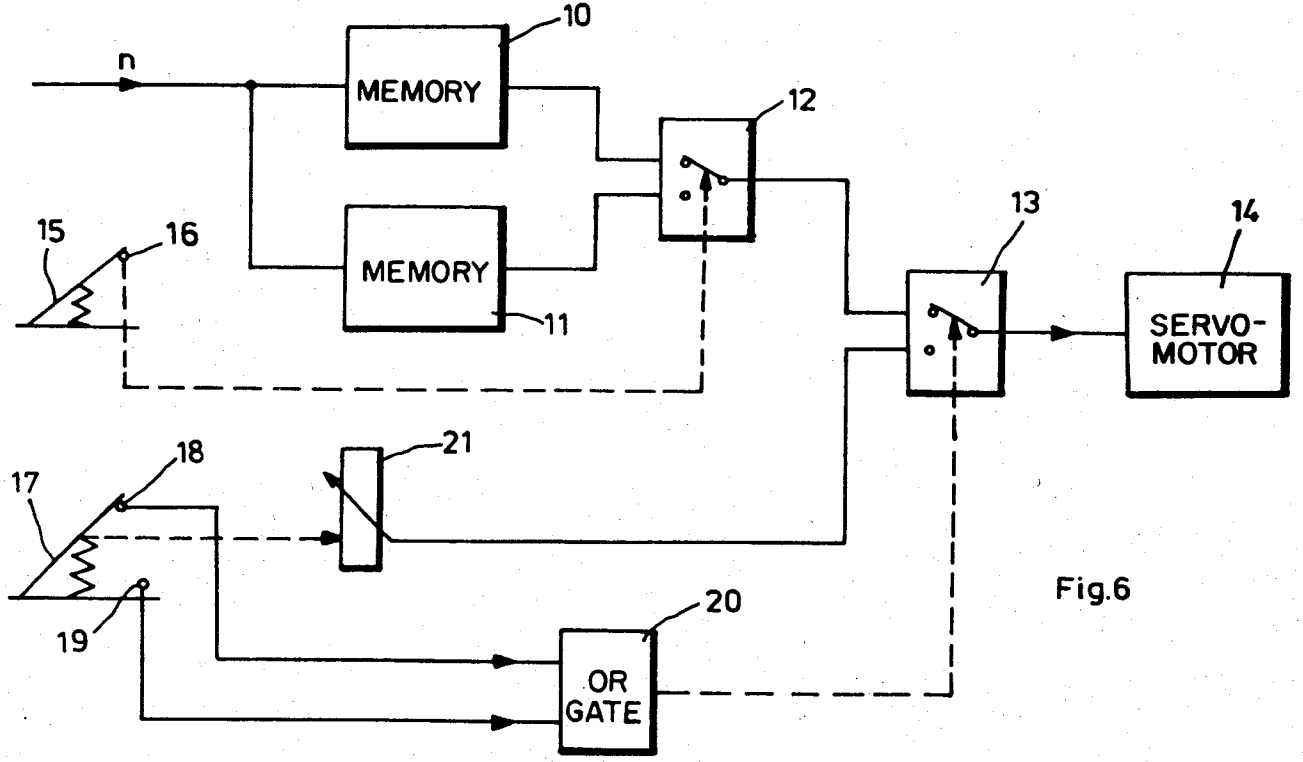
FIG. 6 is a block diagram illustrating an embodiment of the present invention.

FIG. 6 is a block diagram illustrating a control apparatus in accordance with the invention. A memory device 10 is provided of storing, for example in digital computer memory format, the optimum consumption curve b and which comprises the values of throttle setting for each value of rotational speed. Memory 11 stores the curve a for the start-up. These memory devices are provided with a signal input n from an engine speed sensor. Speed n corresponds to the actual rotational speed of the engine. Memory devices 10 and 11 are selectively connected by switch 12 and switch 13 to an adjusting servo-motor 14, which operates the throttle valve or the control valve for an injection pump. Switch 12 is connected to memory 10 for optimum fuel operation when the clutch is in its fully engaged position which is sensed by sensing switch 16 at the clutch pedal 15. Switch 12 moves to its lower position for reading of memory 11 when the clutch pedal 15 is depressed, so that the engine operation can be accorded to an optimum curve a for start-up operation. Switch 13 selectively connects the output of switch 12, corresponding to the throttle setting read from memory 10 of memory 11, or the output or accelerator pedal position sensing device 21 to the servo-motor 14. When the accelerator pedal 17 is either in the idling position, closing contact 18, or in the full throttle position, closing contact 19, OR gate 20 provides a signal which moves switch 13 into the downward position, connecting accelerator position sensing device 21 directly to servo-motor 14 so that the throttle of the engine is directly controlled by the accelerator.

Figure 7:
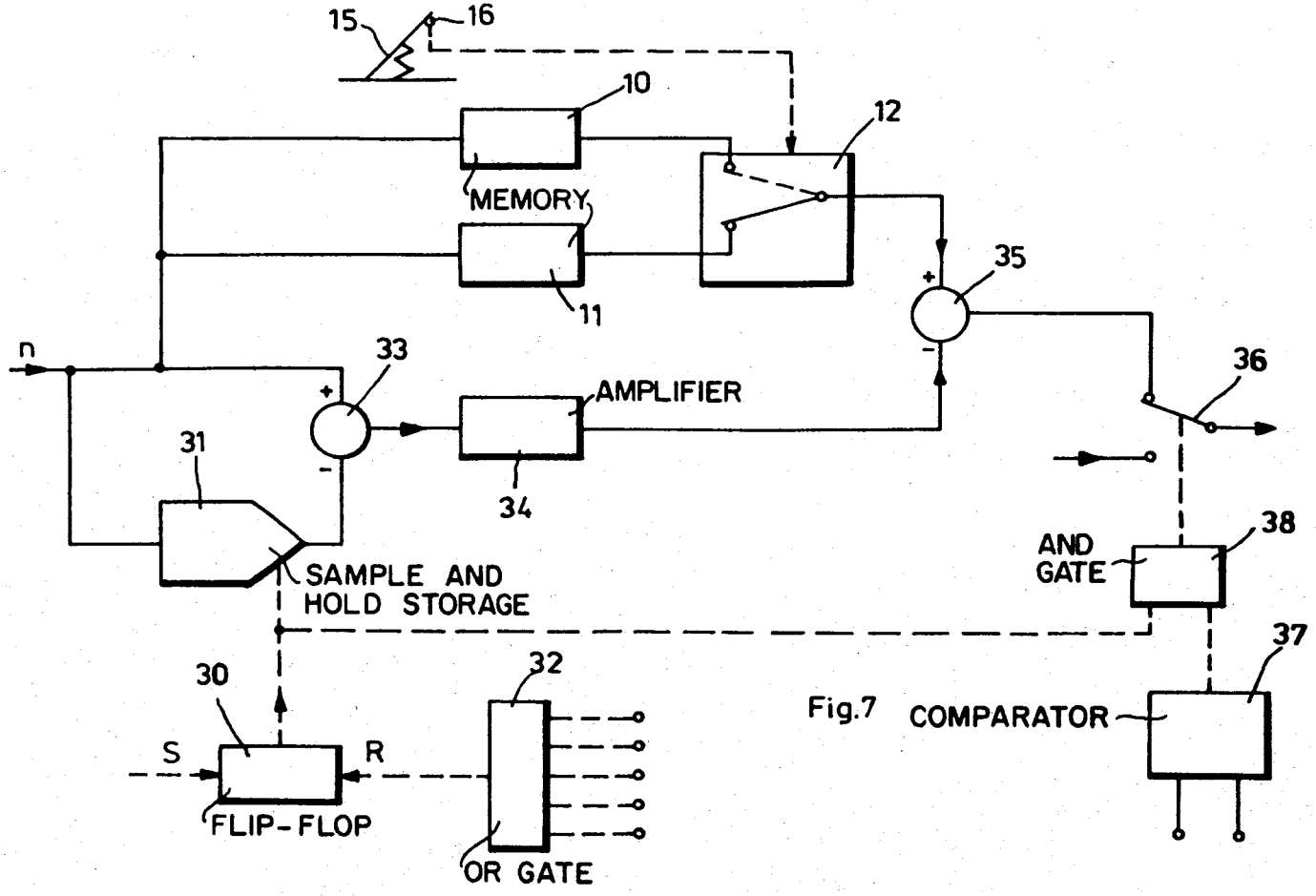
FIG. 7 is a block diagram illustrating another embodiment of the present invention incorporating vehicle speed regulation.

The embodiment of FIG. 7 includes similar components as are illustrated with respect to FIG. 6, which are designated by like reference numerals. The arrangement of FIG. 7 is supplemented by the provision of a speed limitation and regulation according to curve branches $c_1$, $c_2$ etc. in the diagram shown in FIG. 5. A switch is provided which delivers a drive signal to the input S of a flip-flop 30. This signal is provided when the engine is turning at a speed corresponding to the desired speed. The rotational speed signal n is stored in the sample and hold storage 31 until an end signal arrives from OR gate 32 at the reset R input of flip-flop 30. The end signal is generated in case one of the contacts in switches connected to one of the inputs of OR gate 32 produces a signal, corresponding to "clutch pedal depressed", "main switch of the arrangement in disconnect position", "gas pedal in idling position", "gas pedal in full throttle position" or "speed regulator or governor disconnected". Logic element 33 forms the difference between the rotational speed stored in 31 and the actual value of the rotational speed. This speed difference is amplified by amplifier 34 and is provided to the subtraction element 35, so that the throttle valve servo-motor connected to switch 36 is provided with a setting signal which is determined by the difference formed in 35 between the signal stored in the memory 10 and the signal output from amplifier 34. Because the speed difference signal formed in comparator 33 is amplified by amplifier 34 before being supplied to the negative terminal of comparator 35, engine output power will be rapidly decreased by any increase in engine speed beyond the selected speed. This will place the operating point of the engine on one of the downwardly branching curves c shown in FIG. 5 and cause the operating point of the engine to be displaced along this branch for purposes of regulating the speed.

If an overrunning device is provided and a downward drive or the like occurs, comparator 37, the inputs of which are provided with the rotational speed of the transmission and the speed stored at 31, will forward to the AND gate 38 and to the switch 36, a "switch over" signal whenever the difference between the speed values attains a threshold value. As a result, the throttle valve will be moved into its idling position and the fuel consumption will be reduced to a minimum.

The setting of the speed to be stored in curve 31, and thereby the pertinent branch curve c may be obtained by making use of a lever in addition to a graduated scale on the instrument panel, or by means of a pulse delivered in the kickdown position of the accelerator pedal when the vehicle is at the desired speed. For disconnection an additional contact on the brake pedal may also be provided. It is useful that the position of the branch curve c in the diagram shown in FIG. 5 be gear-dependent, that is, fixed in the lower gears at approximately half the maximum rotational speed of the engine in consideration of fuel savings, and for protection from engine racing. The speed values may be settable in the highest transmission speed.

In connection with the apparatus it may also be helpful to provide the operator with a signal for shifting into the next highest gear of the transmission whenever the optimum velocity is reached or when the operating point leaves the optimum consumption range. The pertinent rotational speed value is obtained when the specific fuel consumption, that is fuel consumption relative to power, is approximately equal before and after shifting to the next highest gear. On further running up along curve b, the operating point will again pass through the consumption minimum.

The invention may be used in combination with systems, such as disclosed in U.S. Patent Application Ser. No. 955,186, filed Oct. 27, 1978, now U.S. Pat. No. 4,252,208, wherein the engine is brought to a halt automatically or manually upon the absence of a load upon the engine.

In order to simplify the structure switch 4 can be eliminated and curve a can be used for stabilizing the idling speed of the engine.

For use in connection with an automatic transmission, the operation can occur along curve b in all shift lever positions upon actuation of the accelerator pedal. As is customary, the shift points can depend on the accelerator pedal position, so that when the accelerator pedal travel is small, shifting to the next higher gear will occur at a small rotational speed, and at a larger pedal travel, shifting will occur at higher rotational speeds. If the accelerator pedal is depressed to full throttle, the servomotor and control unit 2 will switch the fuel metering device to full throttle. If this is undesired for other reasons, for example, limitation of noise level, the full throttle position may activate a warning flasher light, limiting operation to an emergency or special situation.

The arrangement for an adjustable speed regulation control is as simple and useful in automatic transmissions as in mechanical transmissions. Switch 4 in FIG. 2 is then dispensed with. The shifting points, as customary for automatic transmissions, are dependent upon the accelerator pedal position. In order to provide operation in connection with cold starting, the throttle settings for each operating speed of the engine may vary according to the temperature of the engine.

While there have been described what are believed to be the preferred embodiments of the present invention, those skilled in the art will recognize other and further modifications may be made thereto without departing from the spirit of the invention, and it is intended to claim all such embodiments as fall within the true scope of the invention.

I claim:

1. Apparatus for controlling the setting of a fuel metering device for an internal combustion engine for a motor vehicle having an accelerator pedal, to provide the setting which yields the highest ratio of output power to fuel consumption for each operating speed of said engine, comprising:

an engine speed sensor;

a memory for storing the fuel metering device settings to be used at each engine speed said memory including means responsive to said speed sensor for providing an output setting;

operating means responsive to said memory output for setting said fuel metering device; and a first switch operated by said accelerator pedal for connecting said memory to said operating means as long as the accelerator pedal is moved from its at-rest position.

2. Apparatus as specified in claim 1, wherein said first switch alternately connects said operating means to said memory or to said accelerator pedal.

3. Apparatus as specified in claim 2 for use in a vehicle including a clutch wherein said memory stores second fuel metering device settings for each engine speed, said second settings being appropriate for start-up, and wherein said means for providing an output setting is responsive to movement of said clutch out of the engaged position to select said output setting from said second settings.

4. Apparatus as specified in claim 1 wherein said vehicle has a transmission having an overrun mechanism operative in at least one transmission speed.

5. Apparatus as specified in claim 1 for a vehicle having a multi-speed transmission wherein said stored device settings provide output power settings as a function of engine speed, which are close to the traction resistance curve for said vehicle in the highest speed of said transmission.

6. Apparatus as specified in claim 1 wherein said vehicle includes a brake pedal, and wherein there are provided means, responsive to operation of said brake, for causing said operating means to set said fuel metering device to idling position.

7. Apparatus as specified in claim 1 wherein there is provided a fuel consumption indicator, responsive to said memory output.

8. Apparatus as specified in claim 1 wherein there is provided means, responsive to said speed representative signal, for indicating that a shift in transmission gear is appropriate.

9. Apparatus as specified in claim 1 for use in a vehicle including a clutch wherein said memory stores second fuel metering device settings for each engine speed, said second settings being appropriate for start-up, and wherein said means for providing an output setting is responsive to movement of said clutch out of the engaged position to select said output setting from said second settings.

10. Apparatus as specified in claim 1 wherein the predetermined values of fuel metering device settings are variable as a function of engine temperature.

11. Apparatus as specified in claim 1 wherein there are provided means, responsive to engine speed signals, for modifying said memory output signal thereby to limit the rotational speed of said engine.

12. Apparatus as specified in claim 11 further comprising a switch for setting an engine speed at which said memory output is modified.

13. Apparatus as specified in claim 11 wherein said means limit said rotational speed to selected fixed values in lower transmission speeds and to adjustable values in the highest transmission speed.

14. Apparatus as specified in claim 13 wherein said lower transmission speed operating speed of the engine is set at approximately half the maximum engine speed.

15. Apparatus as specified in claim 11 wherein there is provided a storage apparatus for storing a signal representative of the desired rotational speed of said engine.

16. Apparatus as specified in claim 15 wherein there is provided means for providing a manual input to said storage means.

17. Apparatus as specified in claim 15 wherein said storage means for said desired speed is set at the actual speed upon brief movement of said accelerator pedal into said full throttle position.

18. Apparatus as specified in claim 15 wherein said storage setting is removed by a step selected from operation of a brake pedal of said vehicle or an idle contact of said accelerator pedal.

19. Apparatus for controlling the setting of a fuel metering device for an internal combustion engine for a motor vehicle having an accelerator pedal, to provide the setting which yields the highest ratio of output power to fuel consumption for each operating speed of said engine, comprising:

an engine speed sensor;

a memory for storing the fuel metering device settings to be used at each engine speed said memory including means responsive to said speed sensor for providing an output setting;

operating means responsive to said memory output for setting said fuel metering device; and a first switch operated by said accelerator pedal for connecting said memory to said operating means wherein said first switch alternately connects said operating means to said memory or to said accelerator pedal, wherein said accelerator pedal has a second switch, responsive to the idle position, and a third switch, responsive to the full throttle position, and wherein said first switch connects said operating means to said pedal upon operation of either of said second or third switches.

20. Apparatus as specified in claim 19, further comprising a signaling device responsive to operation of said third switch.

21. Apparatus as specified in claim 20 for use in a vehicle including a clutch wherein said memory stores second fuel metering device settings for each engine speed, said second settings being appropriate for start-up, and wherein said means for providing an output setting is responsive to movement of said clutch out of the engaged position to select said output setting from said second settings.

22. Apparatus as specified in claim 19 for use in a vehicle including a clutch wherein said memory stores second fuel metering device settings for each engine speed, said second settings being appropriate for start-up, and wherein said means for providing an output setting is responsive to movement of said clutch out of the engaged position to select said output setting from said second settings.

* * * * *